US005868954A

United States Patent [19]

Yoshino et al.

[11] Patent Number: 5,868,954

[45] Date of Patent: Feb. 9, 1999

[54] METHOD FOR JOINING IMMERSION NOZZLE

[75] Inventors: Ryoichi Yoshino; Kenji Yamamoto; Tadao Taniguchi, all of Okayama, Japan

[73] Assignee: Shinagawa Refractories Co., Ltd., Tokyo, Japan

[21] Appl. No.: 962,060

[22] Filed: Oct. 31, 1997

[30] Foreign Application Priority Data

Nov. 15, 1996 [JP] Japan ..... 8-305184

[51] Int. Cl.[6] ..... B22D 41/50

[52] U.S. Cl. ..... 222/590; 222/606

[58] Field of Search ..... 222/590, 606, 222/607; 266/44; 164/437, 337

[56] References Cited

U.S. PATENT DOCUMENTS 4,669,528 6/1987 Szadowski ..... 164/437

FOREIGN PATENT DOCUMENTS 0 282 247 9/1988 European Pat. Off. .
1 157 818 7/1969 United Kingdom .

OTHER PUBLICATIONS

English language Abstract of Japanese Publication No. 60199556, published Oct. 9, 1985.

English language Abstract of Japanese Publication No. 62040959, published Feb. 21, 1987.

Derwent Publication XP–02067924 Feb. 1987.

Patent Abstracts of Japan, vol. 010, No. 222 (M–504), 2 Aug. 1986 & JP 61 060246 A (Nippon Kokan KK), 27 Mar. 1986, *Abstract*.

Patent Abstracts of Japan, vol. 013, No. 420(M–872), 19 Sep. 1989 & JP 01 157750 A (NKK Corp.), 21 Jun. 1989, *Abstract*.

Patent Abstracts of Japan, vol. 004, No. 158 (M–039), 5 Nov. 1980 & JP 55 109550 A (Shinagawa Refract Co Ltd), 23 Aug. 1980, *Abstract*.

*Primary Examiner*—Scott Kastler
*Attorney, Agent, or Firm*—Wenderoth, Lind & Ponack, L.L.P.

[57] ABSTRACT

A method of joining an immersion nozzle to a refractory member is disclosed, wherein a sealing-agent layer is formed on the upper joining surface of the immersion nozzle, and an exfoliating-agent layer is formed on the lower joining surface of the refractory member.

8 Claims, 1 Drawing Sheet

METHOD FOR JOINING IMMERSION NOZZLE

BACKGROUND OF THE INVENTION

1. Field of the Invention

The present invention relates to a method for joining an immersion nozzle used when molten metal is made to flow out from a molten metal vessel, and more specifically, to a method for joining the upper surface of an immersion nozzle to a lower plate brick or to a lower nozzle.

2. Description of the Related Art

Since the lower portion of an immersion nozzle used in a continuous casting apparatus is continuously immersed in and eroded by molten metal, when it becomes necessary, it must be replaced with a new immersion nozzle. Therefore, the immersion nozzle is joined to either the lower plate brick of a sliding nozzle or a lower nozzle which is located above the immersion nozzle, by method that makes replacement possible.

For example, when the upper surface of an immersion nozzle is joined to the lower plate brick of a sliding nozzle or to a lower nozzle, a method of inserting packing between the joining surfaces has conventionally been employed. According to this method, packing is set on the preheated immersion nozzle and the immersion nozzle is joined with the lower plate brick or the lower nozzle. The packing is composed of a packing material or a filler which is disclosed in, for example, Japanese Patent Publication No. 61-14111, Japanese Patent Laid-Open No. 4-154676, Japanese Patent Laid-No. 5-163073 and Japanese Patent Laid-Open No. 5-163074.

This method, however, has problems in that the work environment is deteriorated, the joining operation cannot be confirmed visually, etc., because, after the packing is set to the preheated immersion nozzle, smoke and bad smells are generated from the binder when the immersion nozzle is joined with the lower plate brick or the lower nozzle. Also, between the time that packing is set to the preheated nozzle and the nozzle is joined with the lower plate brick or the lower nozzle the packing is heat cured, and problems such as the sealing property becoming poor, air suction, molten steel leakage, and abnormally melting of nozzle bricks occur.

Although a method of pre-bonding or mounting a packing to the lower plate brick or the lower nozzle and joining it with the preheated immersion nozzle is also used, this method has problems in that the joining operation cannot be visually confirmed and the parts cannot be automatically joined using a sensor because the heat of the immersion nozzle causes the packing to generate smoke.

To solve the aforesaid problems when packing is used, a method of providing a plate-shaped sliding portion on the upper portion of the immersion nozzle and pressing it against a sliding plane surface portion formed on the lower portion of the lower plate brick or the lower nozzle is used. This method is advantageous in that since no packing is necessary in the portion where the immersion nozzle and lower plate brick or the lower nozzle are joined, the immersion nozzle can be replaced in a short time. Thus, this method is employed in the immersion nozzle replacing apparatus disclosed in, for example, U.S. Pat. No. 4,669,528.

However, since the portion where the immersion nozzle and the lower plate brick or the lower nozzle are joined is required to have sealing properties to prevent oxidation of molten steel due to gas being sucked into the immersion nozzle and the like, the plate-shaped sliding portion formed on the upper portion of the immersion nozzle and the sliding plane surface portion formed on the lower portion of the lower plate brick or the lower nozzle must be smoothly finished. This is to prevent the suction of the gas when the immersion nozzle is pressed against the lower plate brick or the lower nozzle. The cost is thus increased by this smooth finish machining. In addition, the immersion nozzle and the lower plate brick or the lower nozzle which have been smoothly finished must be carefully handled so that the sliding portions are not damaged.

Further, there is a fear that the sealing properties of the immersion nozzle replacing apparatus disclosed in, for example, U.S. Pat. No. 4,669,528 can be lowered. This is caused when the immersion nozzle is replaced. Since the plate-shaped sliding portion formed on the upper portion of the immersion nozzle and the sliding plane surface portion formed on the lower portion of the lower plate brick or the lower nozzle move in a state of contact with each other, there is the danger that the sliding portions of both parts may be damaged during replacement and their smooth finish become scratched, resulting in that when both parts are pressed against each other, gaps will be formed by the scratches.

SUMMARY OF THE INVENTION

An object of the present invention is to provide a simple method of joining an immersion nozzle in a short time without deteriorating the working environment with the generation of smoke and the like.

More specifically, an object of the present invention is to provide a method for joining an immersion nozzle with a refractory member, the method being arranged such that a sealing-agent layer is formed on the upper joining surface of the immersion nozzle.

Another object of the present invention is to provide a method of joining an immersion nozzle with a refractory member, the method being arranged such that a sealing-agent layer is formed on the upper joining surface of the immersion nozzle, and an exfoliating-agent layer is formed on the lower joining surface of the refractory member.

DETAILED DESCRIPTION OF THE INVENTION

Figure 1:
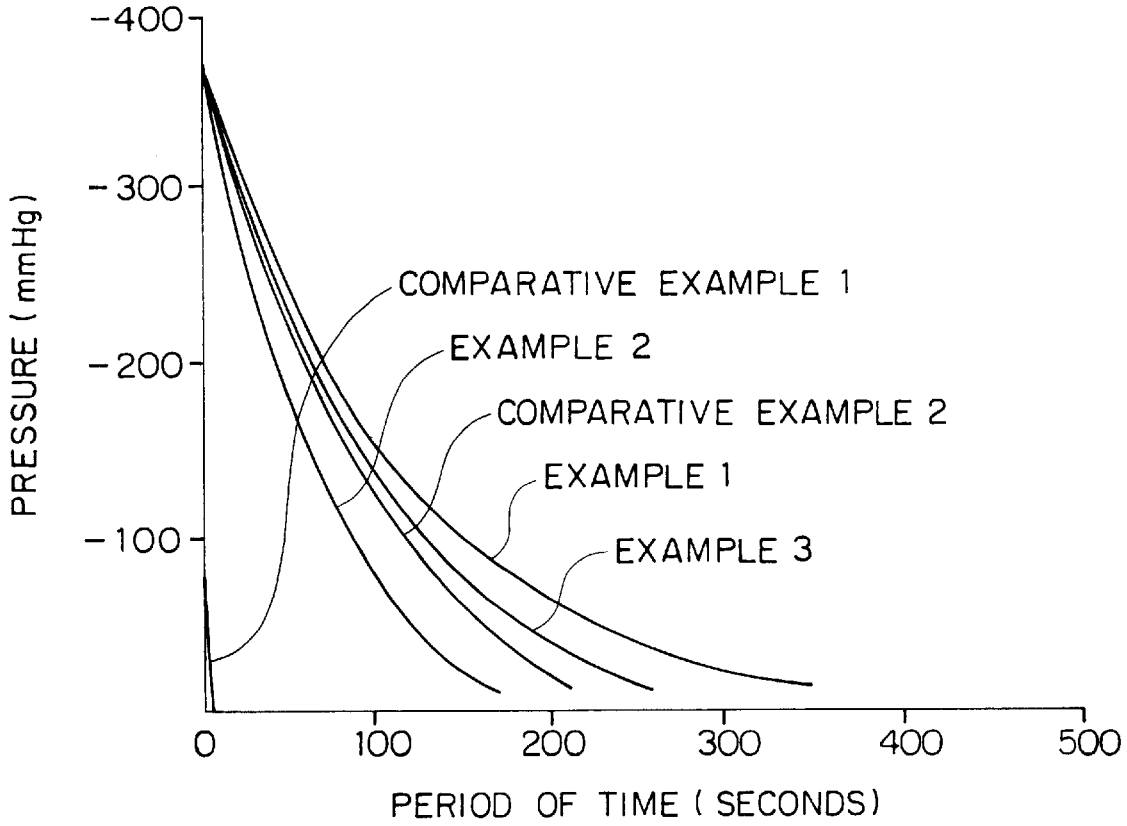
FIG. 1 is a graph showing the results of the sealing property evaluation tests.

A first feature of the present invention is to employ an immersion nozzle when molten metal is made to flow out from a molten metal vessel, the immersion nozzle being arranged such that when it is joined with a refractory member such as a lower plate brick or a lower nozzle, a sealing agent has already been coated on the upper joining surface of the immersion nozzle to thereby form a sealing-agent layer. The formation of the sealing-agent layer on the upper joining surface of the immersion nozzle permits a joining portion to be provided which can achieve excellent sealing properties by only pressing the immersion nozzle against the refractory member, i.e. without the need for smoothly finished joining surfaces. Thus, the cost necessary to smoothly finish the joining surfaces can be eliminated. In addition, even if scratches and the like are made on the lower joining surface of the refractory member, excellent sealing properties can still be provided.

The material of the immersion nozzle is not particularly limited in the present invention, but any material ordinarily used in molten metal vessels such as alumina-carbon, melted quartz, zirconia-carbon and the like may be used.

The material of the lower plate brick of a sliding nozzle or a lower nozzle (flow straightening nozzle) and the like is not particularly limited in the present invention, but any ordinarily used material such as alumina-carbon, high alumina, zircon and the like may be used.

The sealing agent used in the present invention has a composition containing, for example, $SiO_2$: 55–65 wt %, $Al_2O_3$: 5–25 wt %, $B_4C$: 0–20 wt %, $B_2O_3$: 0–10 wt %, $R_2O$ (R represents alkali metal): 0–20 wt %, SiC: 0–10 wt %, C: 0–10 wt %, and preferably $SiO_2$: 60 wt %, $Al_2O_3$: 20 wt %, SiC: 5 wt %, $B_2O_3$: 4 wt %, $R_2O$: 6 wt % and the remainder: 5 wt %.

Further, the sealing-agent layer formed on the upper joining surface of the immersion nozzle has a thickness within the range of 0.2–1.0 mm and preferably within the range of 0.4–0.7 mm. A sealing-agent layer thickness of less than 0.2 mm is not preferable because, unless the joining surface is smoothly finished to pinpoint accuracy, excellent sealing properties cannot be maintained. However, a sealing-agent layer thickness exceeding 1.0 mm is also not preferable from the viewpoint of safety because the sealing-agent layer itself is melted.

The sealing-agent layer can be formed at any time and when, for example, it is formed at the time the immersion nozzle is made, the troublesome job of replacing the immersion nozzle in the field can be eliminated.

The sealing-agent layer can be obtained by preparing material compounds each having a predetermined ratio such that the above mentioned composition can be obtained, making the thus prepared material compounds into a slurry by adding and mixing solvent to them, coating the slurry to the upper joining surface of the immersion nozzle by an arbitrary method such as with a brush or the like, and drying it.

According to the method of the present invention, excellent and stable sealing properties can be provided by the joining portion by merely pressing the immersion nozzle having the sealing-agent layer formed on the upper joining surface thereof against the lower joining surface of a refractory member such as the lower plate brick or the lower nozzle. Note, the method of joining the immersion nozzle to the refractory member is not particularly limited, but any arbitrary conventionally used method may be employed.

Further, according to the method of the present invention, since the formation of an exfoliating-agent layer on the lower joining surface of a refractory member such as the lower plate brick or the lower nozzle can prevent seizure and the like of the sealing-agent layer formed on the upper joining surface of the immersion nozzle to the lower joining surface of the refractory member, the immersion nozzle can be replaced more simply and promptly. That is to say, the heat which is applied to the immersion nozzle during use may cause the sealing-agent layer to seize to the lower joining surface of the refractory member. In this case, the immersion nozzle must be removed and the lower joining surface of the refractory member must be cleaned before the next immersion nozzle is mounted. However, the formation of the exfoliating-agent layer on the lower joining surface of the refractory member makes this unnecessary.

Ordinarily, the exfoliating-agent layer is coated to the sliding surface of the plate brick of a sliding nozzle and is composed of, for example, graphite or the like.

The exfoliating-agent layer formed on the lower joining surface of the refractory member has a thickness within the range of 0.05–0.5 mm and preferably within the range of 0.2–0.3 mm. An exfoliating-agent layer thickness of less than 0.05 is not preferable because the exfoliating property is lowered. However, an exfoliating-agent layer thickness exceeding 0.5 mm is also not preferable because the permeability of the joining portion increases.

The exfoliating-agent layer may be provided in any fashion, for example, it may be shipped after being coated on the refractory member when it is made. The exfoliating-agent layer can be obtained by preparing material compounds each having a predetermined ratio such that the above composition can be obtained, making the thus prepared material compounds into a slurry by adding a solvent, such as, sodium silicate, phosphoric acid, etc., joining and mixing them, coating the slurry onto the lower joining surface of the refractory member and drying it.

Also in the embodiment, excellent and stable sealing properties can be provided by the joining portion by merely pressing the immersion nozzle having the sealing-agent layer formed on the upper joining surface thereof against the lower joining surface, on which the exfoliating-agent layer is formed, of a refractory member such as the lower plate brick or the lower nozzle. Further, the immersion nozzle can be simply and promptly replaced without causing problems such as seizure of the joining portion and the like. The method of joining the immersion nozzle to the refractory member is not particularly limited, but any conventionally used method can be employed.

As described above, according to the present invention, by simply providing the sealing-agent layer on the upper joining surface of the immersion nozzle, when the immersion nozzle is joined to a refractory member such as the lower plate brick or the lower nozzle, sealing properties which are superior to the joining using a packing material or the like can be provided, and no smoke and bad smell are generated even if the joining portion is subjected to heat.

Further, the formation of the exfoliating-agent layer to the lower joining surface of the refractory member can prevent seizure of the sealing-agent layer to the refractory member, which permits the immersion nozzle to be simply and promptly replaced.

EXAMPLES

The method of the embodiments of the present invention will be described below in more detail with reference to the following examples.

Example 1

Figure 2:
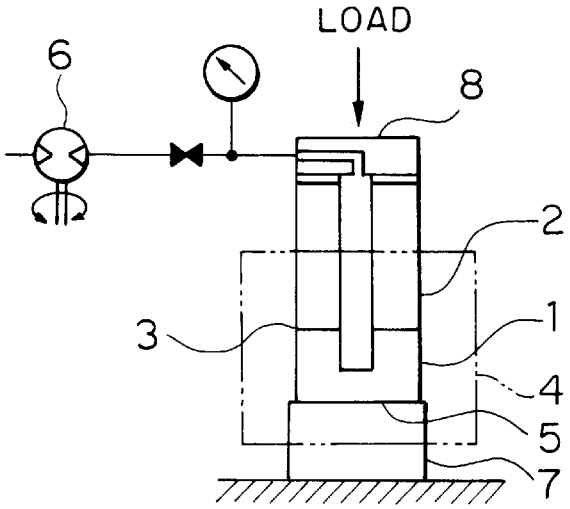
FIG. 2 is a schematic view of a device used to evaluate the sealing capability of the joined portion in the examples and comparative examples.

To evaluate the performance of the method for joining the immersion nozzle according to the present invention, an experiment was executed using a device as shown in FIG. 2 which imitated the lower nozzle (flow straightening nozzle) and the immersion nozzle. In FIG. 2, a cylinder (2) imitated the lower nozzle and was composed of an alumina carbon refractory material having a composition containing $Al_2O_3$: 73 wt %, $SiO_2$: 9 wt % and C:14 wt %; the cylinder (2) had an inside diameter of 70 mm, an outside diameter of 130 mm and a length of 400 mm.

A cylinder (1) was used to imitate an immersion nozzle and was composed of an alumina silica carbon refractory material having a composition of $SiO_2$: 24 wt %, $Al_2O_3$: 44 wt % and C+SiC: 31 wt %; the cylinder (1) had an inside diameter of 70 mm, an outside diameter of 130 mm and a length of 150 mm with a hole defined so as not to pass completely through the length. A sealing agent having a composition of $SiO_2$: 60 wt %, $Al_2O_3$: 20 wt %, $B_2O_3$: 4 wt %, $R_2O$:6 wt %, SiC:5 wt %, other:5 wt % was coated on the upper joining surface of the cylinder (1) to thereby provide a sealing-agent layer 0.6 mm thick.

The cylinder (1) was disposed on a placing table (7), the cylinder (2) was connected to the cylinder (1), and the region about the joining portion (3) was in a state such that it could be heated by an electric furnace (4). A temperature measuring means (5) was disposed on the placing table (7).

The cylinder (1) was joined to the cylinder (2) by being pressed thereagainst by a load shown by the arrow in FIG. 2. In example 1, the cylinder (1) was joined to the cylinder (2) by a load of 370 Kg applied thereto through an upper lid (8) which could communicate with a vacuum pump (6) for evaluating the sealing performance.

The temperature of the electric furnace (4) was increased to 1000 ° C. After the temperature of the temperature measuring means (5) increased to 700 ° C., the cylinder (1) was pressed against the cylinder (2). Then the pressure in the system was reduced to −380 mmHg by the vacuum pump (6) and the period of time (seconds) until the pressure in the system returned to atmospheric pressure was measured. FIG. 1 is a graph showing the result of this measurement.

Example 2

The performance of the joining portion was evaluated by the same method as that of Example 1 except that a sealing-agent layer was formed to a thickness of 0.2 mm. FIG. 1 is a graph showing the result of this measurement.

Example 3

The performance of the joining portion was evaluated by the same method as that of the example 1 except that a sealing agent was used which had the composition $SiO_2$:58 wt %, $Al_2O_3$:8 wt %, $B_2O_3$:4 wt %, $R_2O$:17 wt %, SiC:5 wt %, others:9 wt %. FIG. 1 is a graph showing the result of this measurement.

Example 4

The performance of the joining portion was evaluated by the same method as Example 1 except that an exfoliating agent prepared by mixing a graphite material with soda silicate was coated to the lower joining surface of a cylinder (2) to thereby form an exfoliating-agent layer 0.1 mm thick. An excellent result similar to that of Example 1 was obtained. In addition to the above, when the performance of the joining portions was evaluated by the same method as Example 1, except for the exfoliating-agent layers having a thickness of 0.25 mm and 0.4 mm, excellent results which were not different from those of Example 1 were obtained in the respective cases. Further, the cylinder (1) could be easily removed from the cylinder (2), after they were cooled, without the sealing-agent layer remaining on the exfoliating-agent layer of the cylinder (2).

Comparative Example 1

A cylinder (1) was joined to a cylinder (2) by the same method used in Example 1 except that the joining surfaces of the cylinder (1) and the cylinder (1) were smoothly finished and no sealing-agent layer was formed, and the sealing performance of the resulting joining portion was evaluated. The joining surfaces of the cylinder (1) and the cylinder (2) were finished to a degree of smoothness of 0.2 mm or less. The graph in FIG. 1 also shows the result of this measurement.

Comparative Example 2

A cylinder (1) was joined to a cylinder (2) by the same method used in Example 1 except a packing material (outside diameter: 130 mm, inside diameter: 70 mm, thickness: 4 mm and composition: $Al_2O_3$; 67 wt %, $SiO_2$; 25 wt %, C;8 wt %) was inserted between the joining portions (3). No sealing-agent layer was formed on the cylinders (1 and 2) and the sealing performance of the resulting joining portion was evaluated. The packing material was set after the temperature of temperature measuring means (5) increased to 700 ° C., and the cylinder (1) was pressed against the cylinder (2) after the packing material was set. The thickness of the packing material was 1.5–2 mm after the cylinders were pressed against each other. In the comparative example, the generation of smoke and bad smells was observed in heating. The graph of FIG. 1 also shows the result of this measurement.

What is claimed is:

1. A method for joining an immersion nozzle to a refractory member comprising applying a sealing agent containing by weight % $SiO_2$:55–65, $Al_2O_3$:5–25, $B_4C$:0–20, $B_2O_3$:0–10, $R_2O$ wherein R is an alkali metal:0–20, SiC:0–10 and C:0–10, wherein the weight % is not greater than 100%, to an upper joining surface of said immersion nozzle to form a sealing-agent layer on the upper joining surface of said immersion nozzle, and joining the immersion nozzle and refractory member.

2. The method according to claim 1, wherein said refractory member is a lower plate brick or a lower nozzle.

3. The method according to claim 1, wherein said sealing agent layer has a thickness within the range of 0.2–1.0 mm.

4. A method for joining an immersion nozzle to a refractory member comprising applying a sealing-agent layer containing by weight % $SiO_2$:55–65, $Al_2O_3$:5–25, $B_4C$:0–20, $B_2O_3$:0–10, $R_2O$ wherein R is an alkali metal:0–20, SiC:0–10 and C:0–10, wherein the weight % is not greater than 100%, to an upper joining surface of said immersion nozzle to form a sealing-agent layer on the upper joining surface of said immersion nozzle, applying an exfoliating agent to a lower joining surface of said refractory member to form an exfoliating-agent layer on the lower joining surface of said refractory member, and joining the immersion nozzle and refractory member.

5. The method according to claim 4, wherein said refractory member is a lower plate brick or a lower nozzle.

6. The method according to claim 4, wherein said sealing agent layer has a thickness within the range of 0.2–1.0 mm.

7. The method according to claim 4, wherein an exfoliating agent layer has said thickness within the range of 0.05–0.5 mm.

8. The method according to claim 4, wherein said exfoliating-agent is graphite.

* * * * *